US007881642B2

(12) United States Patent
Walsh et al.

(10) Patent No.: US 7,881,642 B2
(45) Date of Patent: Feb. 1, 2011

(54) SIMPLIFIED RESETTING THUMPER ASSEMBLY

(75) Inventors: James D. Walsh, Rochester, NY (US); Timothy P. Foley, Marion, NY (US)

(73) Assignee: Xerox Corporation, Norwalk, CT (US)

( * ) Notice: Subject to any disclaimer, the term of this patent is extended or adjusted under 35 U.S.C. 154(b) by 277 days.

(21) Appl. No.: 12/264,467

(22) Filed: Nov. 4, 2008

(65) Prior Publication Data

US 2010/0061770 A1 Mar. 11, 2010

Related U.S. Application Data

(60) Provisional application No. 61/096,099, filed on Sep. 11, 2008.

(51) Int. Cl.
*G03G 15/08* (2006.01)

(52) U.S. Cl. ..... 399/257; 399/120; 399/358; 399/360

(58) Field of Classification Search ..... 399/120, 399/257, 358, 360
See application file for complete search history.

(56) References Cited

U.S. PATENT DOCUMENTS 4,380,309 A * 4/1983 Takahashi ..... 222/450
5,937,252 A * 8/1999 Peters et al. ..... 399/257

* cited by examiner

*Primary Examiner*—Ryan D Walsh
(74) *Attorney, Agent, or Firm*—Ronald E. Prass, Jr.; Prass LLP

(57) ABSTRACT

This is a thumper assembly that is positioned in a developer station of a xerographic marking system. A waste container connected to a drop tube collects waste developer from this station. A magnet prevents magnetic developer from moving through the tube when the container is removed. Once a new container is installed, the magnet is moved away from the tube thereby allowing magnetic developer lodged therein to again move through the tube. A thumper is moved striking the tube to further dislodge developer and allow this developer to move through the tube into the waste container.

13 Claims, 3 Drawing Sheets

SIMPLIFIED RESETTING THUMPER ASSEMBLY

This application is based upon and relies upon the date of the Provisional application, Ser. No. 61/096,099, on the same invention entitled "Simplified Resetting Thumper Assembly" filed in the U.S. Patent and Trademark Office on Sep. 11, 2008. The title of the Provisional Application is "Simplified Resetting Thumper Assembly". The inventors of this application and the Provisional Application are James D. Walsh and Timothy P. Foley, having the addresses indicated on the first page of this application.

This invention relates to electrostatic imaging systems and, more specifically, to developer stations in said systems.

BACKGROUND

While the present invention can be used in any system comprising a thumper assembly, it will be described herein for clarity as used in electrostatic marking systems such as monochrome or color xerographic developer systems.

In an electrostatographic reproducing apparatus commonly used today, a photoconductive insulating member may be charged to a negative potential, thereafter exposed to a light image of an original document to be reproduced. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with a developing powder referred to in the art as toner. During development, the toner particles are attracted from the carrier particles by the charge pattern of the image areas on the photoconductive insulating area to form a powder image on the photoconductive insulating area. This image may be subsequently transferred or marked onto a support surface such as copy paper to which it may be permanently affixed by heating and/or by the application of pressure. Following transfer of the toner image or marking, the copy paper may be removed from the system by a user or may be automatically forwarded to a finishing station where the copies may be collected, compiled and stapled and formed into books, pamphlets or other sets.

Image consistency is important whether the copies are collected or compiled and formed into books, pamphlets, etc. One important property of print quality is the uniformity of the print. Many parameters of the xerographic process affect print uniformity, but one of the most important ones is consistency and quality of the developer used.

In one color system, an array or series of different color imaging stations are aligned above an endless belt. Each imaging station contains a raster output scanner (ROS), photoreceptor drum in a xerographic module, a development station and cleaning station. The ROS emits an electronic beam (laser) which impinges on the rotating photoconductive drum, thereby causing that location on the drum to undergo a change in electrical charge. As the drum continues to rotate past the development station, toner particles of a color which is unique to that imaging station will attach to the drum at the location charged by the ROS. This colored image is then transferred to an intermediate transfer belt that is passing by and in contact with the photoreceptor drum. As the intermediate belt passes by the different imaging stations (each containing a different color), it picks up subsequent color layers to create a complete color image which is then transferred to media.

Each colored beam must be in substantial registration with the other beams deposited on the belt for a proper final color copy. Also, each color station can be changed or varied when needed. In one embodiment, there are also two sensors (Mark On Belt or MOB sensors) that are fixed in position to a point on the machine frame such that the colored images pass within view of these sensors. These sensors serve to detect the quality of each color and can be used to indicate when a color change is required. This type of color system having an array of ROS units is generally described in U.S. Pat. No. 6,418,286 and is incorporated by reference into this disclosure.

As noted above, the consistency of the color image deposited on the drum is important to print quality. As the drum with the latent image continues to rotate, it passes through the development station which causes toner to stick to the drum where the electrical discharging (by the ROS) has taken place. The quality of the developed image is related to the consistency and quality of the developer material. Developer material is a mixture or blend of toner and carrier. The consistency or quality of the developer is a function of the consistency and quality of both the toner and the carrier. Toner is consumed regularly in the xerographic process and must be replaced at an equal rate. Toner replenishing systems exist to perform such a function. This constant replacement keeps the quality of the toner near the quality of new toner. Carrier is not consumed in the xerographic process and is subject to a constant churning in the developer unit. This constant churning causes the carrier to deteriorate over time. To counter this effect carrier can be added either with the toner or through a separate carrier replenishment system. The relationship of toner to carrier is a key parameter to the quality of the xerographic process. To maintain the relationship of toner to carrier, carrier must be removed or trickled out at the same rate it is added. This removal can be done through a trickle waste system which consists of transport system and a waste storage bottle. The waste bottle will eventually fill and will need to be removed and emptied or replaced.

SUMMARY

This invention provides a low cost thumper assembly to be used in a xerographic development trickle system. As the waste bottle is removed from the machine, a magnet in the thumper assembly rotates close to the drop tube to prevent additional magnetic developer flow and thus from entering the bottle. With no developer flow, the tube packs with developer and will require a transient force (a "thump") to dislodge the material once an empty waste bottle is placed back in the machine. To accomplish this, the empty waste bottle contacts a molded arm with a magnet in the new thumper assembly when it re-enters the machine. This contact rotates the magnet away from the tube as well as causes the molded arm to load a separate molded trigger arm assembly. As the load increases, energy is stored in the thumper's trigger arm device until the release position is reached. At this position, the trigger arms slide off the catch points on the magnet and allow the thumper's mass to strike the drop tube assembly, reestablishing developer flow in the trickle system. A torsion spring on the magnet arm assembly enables the magnet to pass through the trigger arms by flexing the trigger arms laterally to reposition itself close to the drop tube when the waste bottle is removed from the machine again. The magnetic force of the magnet prevents any magnetic developer from flowing through the drop tube. Once the magnetic force is removed by moving the magnet away from the drop tube and the transient force is applied, the magnetic developer will then flow through the tube into the waste container. The previously designed drop tubes used additional rigid components along with a spring loaded dog. Besides the cost reduction enabled by this new design due to the elimination of parts and improved manufacturability, reliability has also improved due to less binding and lower friction in this new assembly.

This invention reduces the number of parts required for an auto resetting thumper assembly. The current prior art approach is more complicated, using many more parts to create a plunger assembly. With many more parts, reliability is reduced and assembly time is increased.

This invention also involves a simple molded part which has mass for thumping, a spring feature to apply force to the mass and arms to act as a self resetting trigger to the thumper. The main housing of the assembly also has plastic flex members to allow for easy assembly. As the waste bottle is removed, the thumper trigger will get reset into a beginning position. Then, as the waste bottle is reinstalled, this thumper will first get loaded against the spring and at some point reach the trigger point. At this point, the thumper will then be released and a thump will be impacted against the target surface.

DETAILED DESCRIPTION OF DRAWINGS AND PREFERRED EMBODIMENTS

Figure 1:
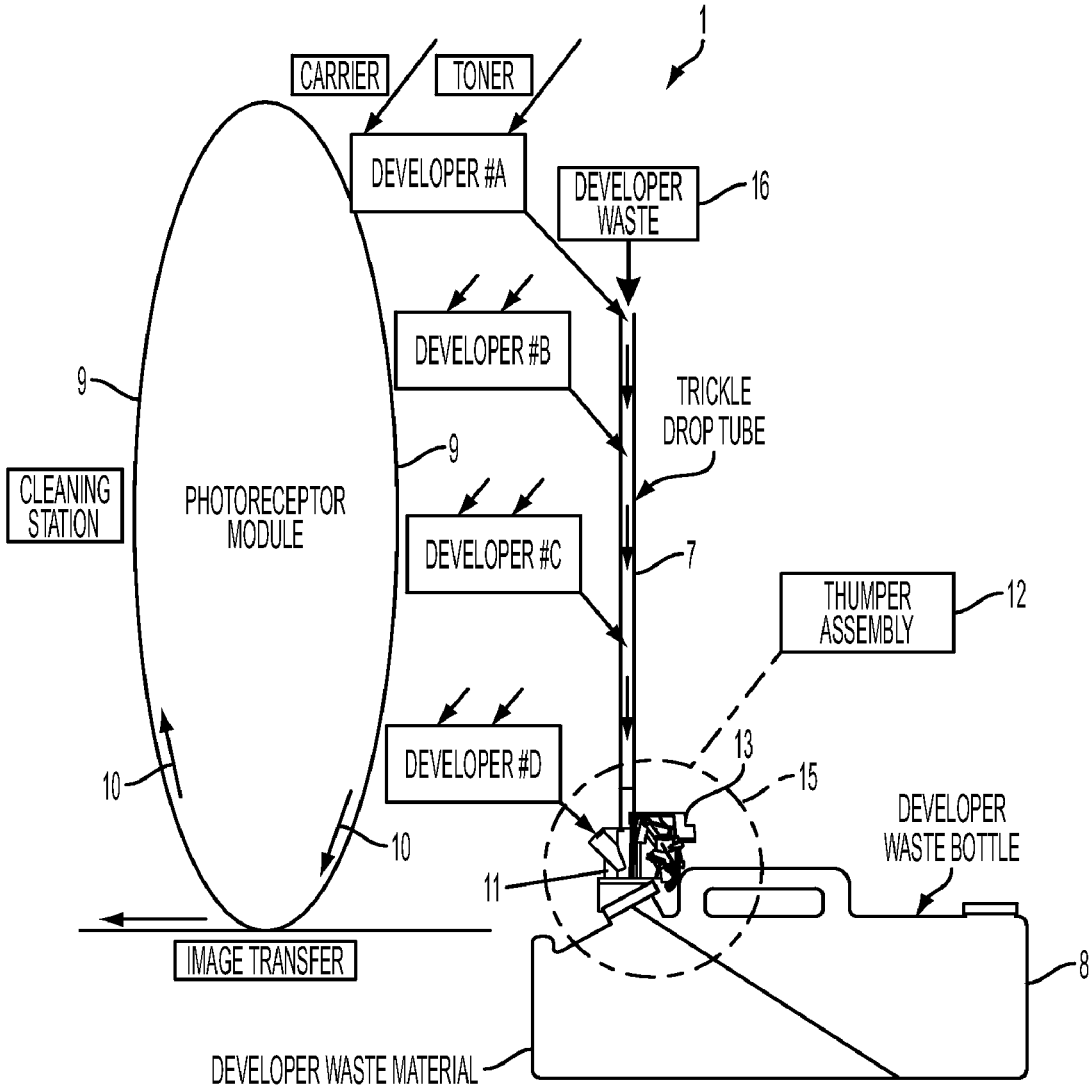
FIG. 1 illustrates a color xerographic marking system having four development stations.

In FIG. 1, a color electrophotographic marking module or system 1 is illustrated having four developer stations A, B, C and D. The photoreceptor module 1 comprises a photoconductive or intermediate belt 9 that travels through each of the development stations. The arrows 10 indicate the travel direction of belt 9. Each station A-D contains a different color magnetic developer that is used to develop a latent xerographic image. Unused or waste magnetic developer is fed from each development station into a common trickle drop tube 7. This waste developer travels from each developer station A-D, through drop tube 7 and into a developer waste bottle or waste container 8. Once the waste container 8 becomes full, it is removed from the system to be replaced with an empty new container. Residual magnetic developer remains, however, in the drop tube 7, and it needs to be prevented from falling out of tube exit 11 once the waste container 8 is removed. The thumper assembly 12 of this invention comprises a movable magnet 13 that when positioned next to drop tube 7 will prevent the flow of magnetic developer through tube 7. Once a new waste bottle or container 8 is installed, the magnet arms 2 contact the container 8 and thereby moves the magnet 13 away from the drop tube 7 as shown in FIG. 1. There is now no magnetic action to prevent developer flow through the tube 7, however some magnetic developer becomes lodged in tube 7 and needs to be released so it can flow into new waste bottle or container 8. The thumper assembly 12 of this invention is used to dislodge this waste magnetic developer as discussed in below descriptions of FIGS. 2 and 3.

Figure 2:
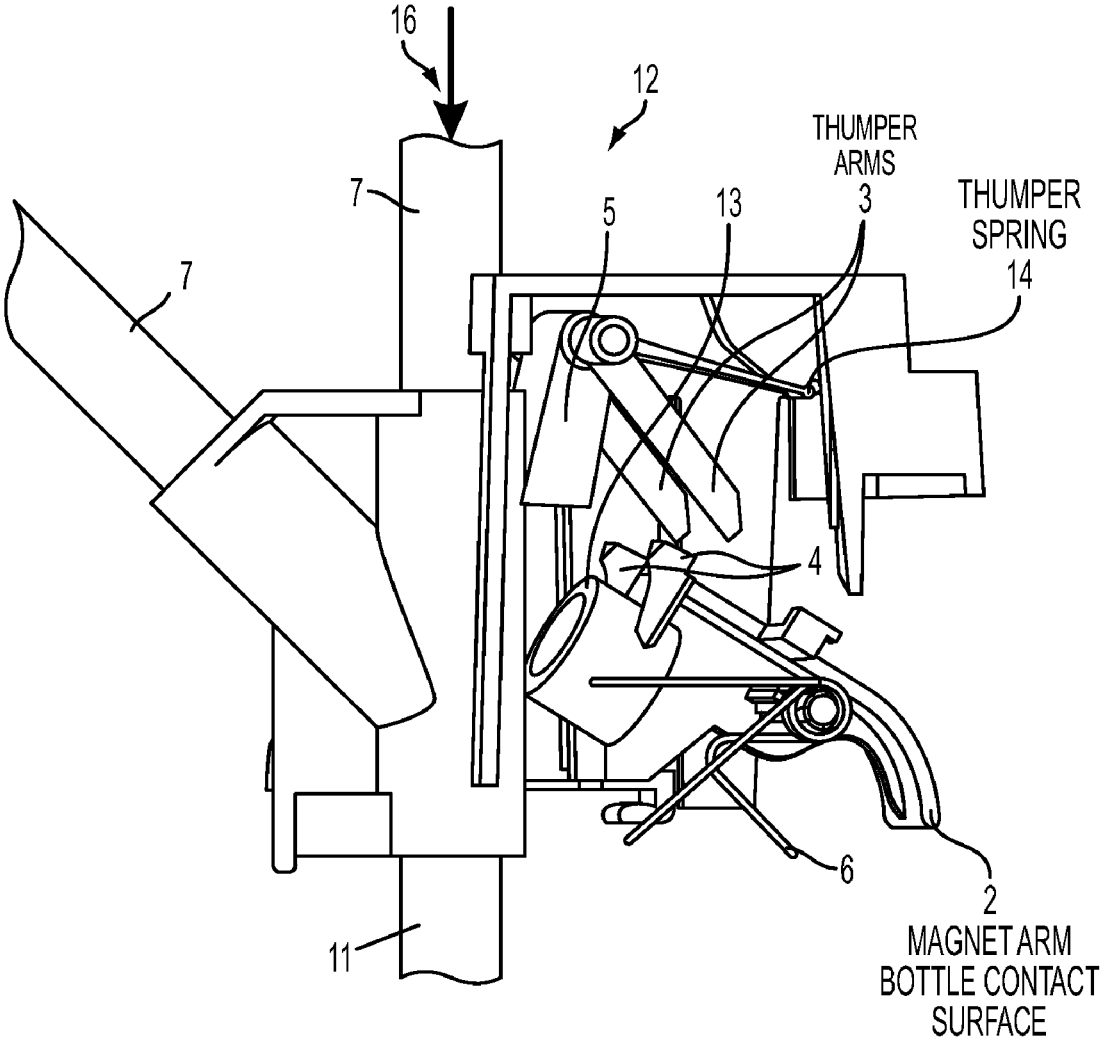
FIG. 2 is a cutaway view of only the thumper assembly of this invention with the waste container removed.

FIG. 2 shows the more critical and specific features of this invention. As a waste bottle 8 is installed into the machine, it will contact the magnet arms 2 where shown. As the bottle 8 slides into the machine, the magnet arm 2 will rotate about its axis in a clockwise direction away from tube 7. At some angle, the magnet arm trigger catch points 4 will contact the thumper trigger arms 3. Further rotation of the magnet arm 2 will cause the thumper 5 to rotate about its axis in a counter clockwise direction. As the magnet arm 2 continues rotating, the thumper spring 14 feature begins to load up. This loading on the thumper spring 14 will continue until the rotation of the magnet arm 2 reaches the release angle. This is the angle at which the trigger catch points 4 no longer hold the thumper trigger arms 3. Once this release angle is reached, further rotation of the magnet arm 2 will cause the trigger arms 3 to release from the trigger catch points 4. At this point, the energy stored in the spring 14 will release and the thumper 5 will rotate in the clockwise direction until it strikes the trickle or drop tubes 7. This thump energy is needed to release the magnetic developer after the flow has been stopped. The next time the waste bottle 8 is removed, the magnet arm 2 will be allowed to rotate in the counter clockwise direction as a result of the torsion spring force. As the magnet arm 2 rotates in this direction, it will come in contact with the trigger arms 3 once again. However, because of the shape of the magnet arm 2 and the very low lateral strength of the trigger arms 3, the trigger arms 3 move to the side and allow the magnet arm 2 to pass through. Resetting the trigger mechanism is provided for the next waste bottle 8 to be inserted. This type of thumper mechanism could be used in many applications and should not be limited to the trickle waste tube application illustrated herein used in this disclosure for clarity and demonstration purposes.

Figure 3:
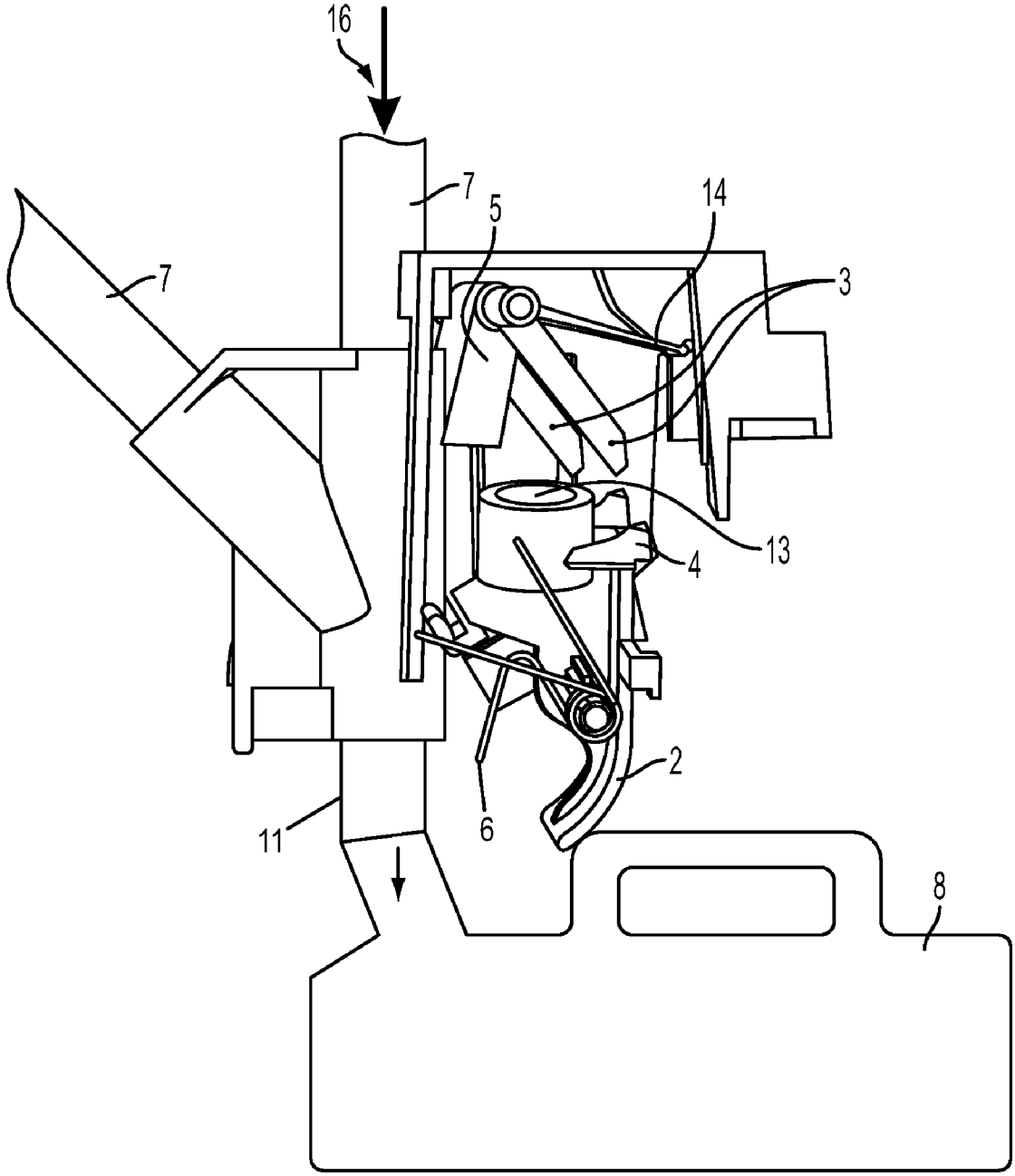
FIG. 3 illustrates the assembly when the waste container moves the magnet away from the drop tubes.

In FIG. 3, as a waste bottle 8 is installed into the machine, it will contact the magnet arms 2 as shown in FIG. 3. As the bottle or container 8 is installed, the magnet arm 2 will rotate about its axis in a clockwise direction moving the magnet 13 away from tube 7. At some angle, the magnet arm trigger catch points 4 will contact the thumper trigger arms 3. As the magnet arm 2 continues rotating, the thumper spring 14 begins to load up. This loading on the thumper spring 14 will continue until the rotation of the magnet arm 2 reaches the release angle. Once this release angle is reached, further rotation of the magnet arm 2 will cause the trigger arms 3 to release from the trigger catch points 4. At this point, the energy stored in the spring 14 will release and the thumper 5 will rotate in clockwise direction until it strikes the drop tube 7. This thump energy is needed to release the magnetic developer after the flow has been stopped.

In summary, the present invention provides a thumper assembly useful in an electrophotographic marking system that uses magnetic developer. This assembly comprises a conduit configured to be attached to a developer waste trickle drop tube, a conduit on its lower end configured to be attached to a removable developer waste bottle or container, a movable magnet with a movable magnet arm(s) and a movable thumper mass. The magnet is enabled to be moved adjacent to the drop tube to thereby prevent magnetic developer movement through the tube. The magnet is configured to be moved away from and against the tube to reduce magnetic action on magnetic developer stuck in the tube. The magnet is configured to prevent flow of developer when abutting the tubes.

The thumper is configured to initiate flow of developer when the thumper strikes the tube. The magnet is enabled to prevent developer flow through the tube and the thumper mass is enabled to initiate and allow flow of developer through the tube.

The waste container when installed in the system is configured to move the magnet away from the tube thereby allowing magnetic developer to flow through the tube into the container when the tube is struck by the thumper mass. The thumper mass is configured to hit the tube to loosen any lodged developer after the magnet is moved away from the tube.

An embodiment of this invention provides a thumper assembly useful in an electrophotographic marking system that uses magnetic developer. This assembly comprises a conduit configured to be attached to a developer waste trickle drop tube, a conduit on its lower end configured to be attached to a removable developer waste bottle or container, a movable magnet with a movable magnet arm(s) and a movable thumper mass. The magnet is enabled to be moved adjacent the drop tube to thereby prevent magnetic developer movement through the tube. The waste container when attached to the assembly is enabled to cause the thumper mass to be spring loaded. The mass is enabled when spring released to strike the tube and thereby loosen, initiate and cause the flow of previously lodge developer through the tube.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A thumper assembly useful in an electrophotographic marking system that uses magnetic developer, said assembly comprising:

a conduit configured to be attached to a developer waste trickle drop tube, a conduit on its lower end configured to be attached to a removable developer waste bottle or container, a movable magnet with a movable magnet arm(s) and a movable thumper mass, said magnet enabled to be moved adjacent said drop tube to thereby prevent magnetic developer movement through said tube;

wherein said magnet is configured to be moved away from and against said tube to reduce magnetic action on magnetic developer stuck in said tube.

2. The assembly of claim 1 wherein said magnet is configured to prevent flow of developer when abutting said tubes.

3. The assembly of claim 1 wherein said thumper is configured to initiate flow of developer when said thumper strikes said tube.

4. The assembly of claim 1 wherein said magnet is enabled to prevent developer flow through said tube and said thumper mass is enabled to allow flow of developer through said tube.

5. The assembly of claim 1 wherein said waste container when installed in said system is configured to move said magnet away from said tube thereby allowing magnetic developer to flow through said tube into said container when said tube is struck by said thumper mass.

6. The assembly of claim 1 wherein said thumper mass is configured to hit said tube to loosen any lodged developer after said magnet is moved away from said tube.

7. A thumper assembly useful in an electrophotographic marking system that uses magnetic developer, said assembly comprising:

a conduit configured to be attached to a developer waste trickle drop tube, a conduit on its lower end configured to be attached to a removable developer waste bottle or container, a movable magnet with a movable magnet arm(s), and a movable thumper mass, said magnet enabled to be moved away from trigger arms and adjacent said drop tube to thereby prevent magnetic developer movement through said tube, said waste container when attached to said assembly is enabled to cause said thumper mass to be spring loaded, said thumper mass configured when spring released to strike said tube thereby loosening, initiating and causing the flow of previously lodged developer through said tube, said mass configured to reset itself as said magnet rotates through said trigger arms.

8. The assembly of claim 7 wherein said magnet is configured to be moved away from and against said tube to reduce magnetic action on developer stuck in said tube.

9. The assembly of claim 7 wherein said magnet is configured to prevent flow of developer when abutting said tubes.

10. The assembly of claim 7 wherein said thumper is configured to initiate flow of developer when said thumper strikes said tube.

11. The assembly of claim 7 wherein said magnet is enabled to prevent developer flow through said tube and said thumper mass is enabled to allow flow of developer through said tube.

12. The assembly of claim 7 wherein said waste container when installed in said system is configured to move said magnet away from said tube thereby allowing magnetic developer to flow through said tube into said container when said tube is struck by said thumper mass.

13. The assembly of claim 7 wherein said thumper mass is configured to hit said tube to loosen any lodged developer after said magnet is moved away from said tube.

* * * * *